US007823414B2

(12) United States Patent
Benos

(10) Patent No.: US 7,823,414 B2
(45) Date of Patent: Nov. 2, 2010

(54) JEWELRY ARTICLE

(75) Inventor: Jennifer S. Benos, Chelmsford, MA (US)

(73) Assignee: Jenuinely Jeni, Inc., Narrows, VA (US)

( * ) Notice: Subject to any disclaimer, the term of this patent is extended or adjusted under 35 U.S.C. 154(b) by 623 days.

(21) Appl. No.: 11/879,164

(22) Filed: Jul. 15, 2007

(65) Prior Publication Data

US 2008/0053149 A1 Mar. 6, 2008

Related U.S. Application Data

(60) Provisional application No. 60/831,176, filed on Jul. 15, 2006.

(51) Int. Cl.
*A44C 25/00* (2006.01)

(52) U.S. Cl. ..... 63/23; D11/7; D11/44; D11/45; D11/67; D11/84

(58) Field of Classification Search ..... None
See application file for complete search history.

(56) References Cited

U.S. PATENT DOCUMENTS

D119,094 S * 2/1940 Phillippe ..... D11/67
2,199,222 A 4/1940 Glaenzer ..... 63/32
2,220,442 A 11/1940 Foret ..... 63/31
D291,666 S 9/1987 Gozlan ..... D11/84

* cited by examiner

*Primary Examiner*—Jack W. Lavinder
(74) *Attorney, Agent, or Firm*—Jones, Tullar & Cooper, P.C.

(57) ABSTRACT

A floral-like jewelry article and method for making the same, the article having a cylindrically cupped body with a closed or base end and an open end, the open end including a plurality of edge portions sectioned and shaped such that the body takes the form of a flower. Each edge portion corresponds to a petal and the body corresponds to a sepal. The base end of the body has a piercing, perforation or hole for receiving a curvilinear strand therethrough with a first strand end extending generally from the base end toward the edge portions and a second strand end extending from the base end, the second strand end corresponding to the flower stem. The first strand end is formed into or mounts one or more pistil-like and/or stamen-like shapes, wherein the body comprises, or is formed from, an empty ammunition cartridge casing or shell, or a shape resembling the same.

10 Claims, 10 Drawing Sheets

JEWELRY ARTICLE

This Application is based on U.S. Provisional Application Ser. No. 60/831,176, filed Jul. 15, 2006, the disclosure of which is hereby incorporated by reference herein in its entirety.

FIELD OF THE INVENTION

The present invention relates generally to ornamentation and, more particularly, to articles for enhancing a wearer's aesthetic appeal.

BACKGROUND OF THE INVENTION

Conventional articles, such as jewelry, for enhancing a wearer's aesthetic appeal include one or more geometric structures constructed of a metallic material mounting an ornament. Commonly, jewelry is constructed of a one or more precious metals, one or more a gem stones, or a combination thereof. For millennia, this simple combination has been utilized by cultures around the world and has encompassed a multitude of different geometries, materials and gem stones in order to accomplish a desired appeal for the particular culture. In turn, the appeal to be captured has resulted in a corresponding number and variety of jewelry styles, each having a unique "look" as characteristic to the designer as one's signature is to a literary work.

A common objective in jewelry design, no matter how sophisticated or crude, has been to create a work of art that not only appeals to the wearer but also creates an impression in the mind of the observer of the person wearing the art. This objective has resulted in innumerable jewelry articles that are highly desirable for their appearance. Both the materials for their construction and methods for producing these articles, however, have too often produced jewelry that is affordable to only a limited portion of the population.

Accordingly, there has long been a desire to provide jewelry that is not only attractive to the wearer or observer, but may also be produced relatively quickly, simply and economically.

OBJECTS AND SUMMARY OF THE INVENTION

Accordingly, it is an object of the present invention to provide a novel jewelry article having superior aesthetic appeal to the wearer or the observer.

Another object of the present invention is to provide a jewelry article that may be produced relatively quickly, simply and economically.

A further object of the present invention is to provide an article of jewelry that is constructed of materials that are readily available, inexpensive and easily worked according to conventional methods of materials forming or the like.

Yet another object of the present invention is to provide an article of jewelry that may be readily formed and/or assembled using conventional tools.

Still another object of the present invention is to provide jewelry articles that are not only highly attractive to the wearer or observer, but may also be produced using materials and methods that make them highly affordable to the consumer.

Yet a further object of the present invention is to provide a novel method of producing highly attractive but affordable jewelry articles that may be implemented relatively quickly, simply and economically.

Still a further object of the present invention is to provide a highly unique and attractive floral-like jewelry article using unique and conventional materials.

It is another object of the present invention to advance the art of jewelry design through the exploitation of non-precious metals and other materials.

It is yet another object of the present invention to advance the art of jewelry manufacture through the use of conventional and non-conventional materials, methods and techniques.

In accordance with one aspect of the present invention, there is provided a floral-like jewelry article having a cylindrically cupped body with a closed or base end and an open end. The open end has a plurality of edge portions sectioned and shaped such that the body takes the form of a flower, each edge portion corresponding to a petal and the body corresponding to a sepal. In addition, the base end of the body has a piercing, perforation or hole for receiving a curvilinear strand therethrough with a first strand end extending generally from the base end toward the edge portions and a second strand end extending from the base end. Also, the second strand end corresponds to the flower stem and the first strand end is formed into or mounts one or more pistil-like and/or stamen-like shapes. Furthermore, the body comprises, or is formed from, an empty ammunition cartridge casing or shell, or a shape resembling the same.

According to another aspect of the present invention, a floral-like jewelry article is provided, the article comprising a plurality of cylindrically cupped bodies. Each body has a closed or base end and an open end, the open end including a plurality of edge portions sectioned and shaped such that the body takes the form of a flower. Each edge portion corresponds to a petal and the body corresponds to a sepal. The base end of the body has a piercing, perforation or hole for receiving a curvilinear strand therethrough with a first strand end extending generally from the base end toward the edge portions and a second strand end extending from the base end. The second strand end corresponds to the flower stem and the first strand end is formed into or mounts one or more pistil-like and/or stamen-like shapes. At least one of the bodies comprises, or is formed from, an empty ammunition casing or shell, or a shape resembling the same.

In accordance with a further aspect of the present invention, a modifiable floral-like jewelry article is provided. The article has a cylindrically cupped body with a closed or base end and an open end, the open end having a plurality of edge portions sectioned and shaped such that the body takes the form of a flower. Each edge portion corresponds to a petal and the body corresponds to a sepal, the base end of the body having a piercing, perforation or hole for receiving a curvilinear strand therethrough with a first strand end extending generally from the base end toward the edge portions and a second strand end extending from the base end. The second strand end corresponds to the flower stem and the first strand end removably mounts one or more components. Each component has a pistil-like and/or stamen-like shape, such that the user may select and modify, at least in part, the appearance of the jewelry article. Again, the body comprises, or is formed from, an empty ammunition cartridge casing or shell, or a shape resembling the same.

According to yet another aspect of the present invention, there is provided a method for producing a floral-like jewelry article. Initially, an empty ammunition housing, or similarly shaped fabricated, dye struck or cast cylindrically-shaped housing is selected, the housing having an open end and a closed or base end, the open end including edge portions and the base end having a piercing, perforation or hole. The housing is then secured in a generally upright position such that the open end is oriented upwardly. Next, a plurality of relatively parallel sections are cut in the housing generally from the edge portions of the open end toward the base end. The sections run along an axis longitudinal with respect to the housing wall, extend a selected distance relative thereto, and define a plurality of adjacent, relatively parallel strip sections. Preferably, the housing and strip sections are then annealed at a selected temperature, and quenched in a selected fluid. Thereafter, the stripped sections are shaped such that each strip takes a form resembling that of a flower petal, and such that the housing takes a form resembling that of a flower. The base end of the body is perforated for slidably receiving a curvilinear strand. Finally, the curvilinear strand is passed through the perforated base end such that a first strand end extends generally from the base end toward the edge portions and a second strand end extends from the base end, the second strand end corresponding to the flower stem.

In accordance with still another aspect of the present invention, there is provided a floral-like jewelry article having a cylindrically cupped body with a closed or base end and an open end. The open end has a plurality of edge portions sectioned and shaped such that the body takes the form of a flower, each edge portion corresponding to a petal and the body corresponding to a sepal. The base end of the body mounts at least one curvilinear strand optionally therethrough with a first strand end extending generally from the base end toward the edge portions. The strand(s) are formed into or mounting one or more pistil-like and/or stamen-like shapes, wherein the body comprises, or is formed from, an empty ammunition cartridge casing or shell, or a shape resembling the same.

According to yet a further aspect of the present invention, a necklace is provided mounting a floral-like jewelry article, the article comprising a cylindrically cupped body with a closed or base end and an open end. The open end has a plurality of edge portions sectioned and shaped such that the body takes the form of a flower, each edge portion corresponding to a petal and the body corresponding to a sepal. The base end of the body has a piercing, perforation or hole for receiving a curvilinear strand therethrough with a first strand end extending generally from the base end toward the edge portions and a second strand end extending from the base end. The second strand end corresponds to the flower stem. The first strand end is formed into or mounts one or more pistil-like and/or stamen-like shapes. Last, the body comprises, or is formed from, an empty ammunition cartridge casing or shell, or a shape resembling the same.

In accordance with still a further aspect of the present invention, a bracelet is provided which mounts at least one floral-like jewelry article including a cylindrically cupped body with a closed or base end and an open end. The open end has a plurality of edge portions sectioned and shaped such that the body takes the form of a flower. Each edge portion corresponds to a petal and the body corresponds to a sepal, the base end of the body has a piercing, perforation or hole for receiving a curvilinear strand therethrough with a first strand end extending generally from the base end toward the edge portions and a second strand end extending from the base end. The second strand end corresponds to the flower stem and the first strand end is formed into or mounts one or more pistil-like and/or stamen-like shapes. The body further comprises, or is formed from, an empty ammunition cartridge casing or shell, or a shape resembling the same.

Another aspect of the present invention relates to an earring that mounts at least one floral-like jewelry article, the article having a cylindrically cupped body with a closed or base end and an open end. The open end includes a plurality of edge portions sectioned and shaped such that the body takes the form of a flower, each edge portion corresponding to a petal. The body corresponds to a sepal, the base end of the body having a piercing, perforation or hole for receiving a curvilinear strand therethrough with a first strand end extending generally from the base end toward the edge portions and a second strand end extending from the base end. The second strand end corresponds to the flower stem and the first strand end is formed into or mounts one or more pistil-like and/or stamen-like shapes. Finally, the body comprises, or is formed from, an empty ammunition cartridge casing or shell, or a shape resembling the same.

Still another aspect of the present invention is directed to a pendant which mounts at least one floral-like jewelry article. Again, the article comprises a cylindrically cupped body with a closed or base end and an open end, the open end having a plurality of edge portions sectioned and shaped such that the body takes the form of a flower. Each edge portion corresponds to a petal and the body corresponds to a sepal. The base end of the body has a piercing, perforation or hole for receiving a curvilinear strand therethrough. A first strand end extends generally from the base end toward the edge portions and a second strand end extends from the base end. The second strand end corresponds to the flower stem and the first strand end is formed into or mounts one or more pistil-like and/or stamen-like shapes. The body comprises, or is formed from, an empty ammunition cartridge casing or shell, or a shape resembling the same.

According to yet another aspect of the present invention, a decorative pin is provided for mounting at least one floral-like jewelry article. The article includes a cylindrically cupped body with a closed or base end and an open end. The open end has a plurality of edge portions sectioned and shaped such that the body takes the form of a flower. Each edge portion corresponds to a petal and the body corresponds to a sepal, the base end of the body having a piercing, perforation or hole for receiving a curvilinear strand therethrough. A first strand end extends generally from the base end toward the edge portions and a second strand end extends from the base end. The second strand end corresponds to the flower stem. In addition, the first strand end is formed into or mounts one or more pistil-like and/or stamen-like shapes. Last, the body comprises, or is formed from, an empty ammunition cartridge casing or shell, or a shape resembling the same.

Still another aspect of the present invention is directed to an earring mounting a floral-like jewelry article. The article similarly has a cylindrically cupped body with a closed or base end and an open end, the open end comprising a plurality of edge portions sectioned and shaped such that the body takes the form of a flower, each edge portion corresponding to a petal and the body corresponding to a sepal. The base end of the body mounts at least one curvilinear strand optionally therethrough with a first strand end extending generally from the base end toward the edge portions, and being formed into or mounting one or more pistil-like and/or stamen-like shapes. The body again comprises, or is formed from, an empty ammunition cartridge casing or shell, or a shape resembling the same.

Yet a further aspect of the present invention is directed to a pendant mounting a floral-like jewelry article having a cylindrically cupped body with a closed or base end and an open end. The open end has a plurality of edge portions sectioned and shaped such that the body takes the form of a flower. Each edge portion corresponds to a petal and the body corresponds to a sepal. The base end of the body mounts at least one curvilinear strand therethrough with a first strand end extending generally from the base end toward the edge portions, and being formed into or mounting one or more pistil-like and/or stamen-like shapes. Moreover, the body comprises, or is formed from, an empty ammunition cartridge casing or shell, or a shape resembling the same.

A decorative pin, in accordance with still another aspect of the present invention, mounts a floral-like jewelry article having a cylindrically cupped body with a closed or base end and an open end. The open end includes a plurality of edge portions sectioned and shaped such that the body takes the form of a flower, each edge portion corresponding to a petal and the body corresponding to a sepal. The base end of the body mounts at least one curvilinear strand optionally therethrough with a first strand end extending generally from the base end toward the edge portions, and being formed into or mounting one or more pistil-like and/or stamen-like shapes. Furthermore, the body comprises, or is formed from, an empty ammunition cartridge casing or shell, or a shape resembling the same.

A simulated floral arrangement, according to another aspect of the present invention, comprises a plurality of floral-like jewelry articles extending upwardly and outwardly from a vase portion. Each article has a cylindrically cupped body with a closed or base end and an open end. The open end is provided with a plurality of edge portions sectioned and shaped such that the body takes the form of a flower, each edge portion corresponding to a petal and the body corresponding to a sepal. The base end of the body includes a piercing, perforation or hole for receiving a curvilinear strand therethrough. A first strand end extends generally from the base end toward the edge portions and a second strand end extends from the base end, the second strand end corresponding to the flower stem and the first strand end being formed into or mounting one or more pistil-like and/or stamen-like shapes. The vase portion mounts each of the plurality of floral-like jewelry articles from their respective second strand ends such that the articles extend upwardly and outwardly therefrom, wherein the bodies and the vase each comprise, or is formed from, an empty ammunition cartridge casing or shell, or a shape resembling the same.

The present invention will now be further described by reference to the following drawings which are not intended to limit the accompanying claims.

BRIEF DESCRIPTION OF THE DRAWINGS

FIG. 1 is a perspective view of a jewelry article, according to one aspect of the present invention, for use as a charm, pendant, broche, decorative pin, earring or the like;

FIG. 7 is a plan view of a plurality of relatively simple, floral-like jewelry articles, in accordance with yet a further aspect of the present invention, for use as earrings, charms, pendants, broche, decorative pins or the like;

The same numerals are used throughout the figure drawings to designate similar elements. Still other objects and advantages of the present invention will become apparent from the following description of the preferred embodiments.

DETAILED DESCRIPTION OF THE PREFERRED EMBODIMENTS

Figure 1:
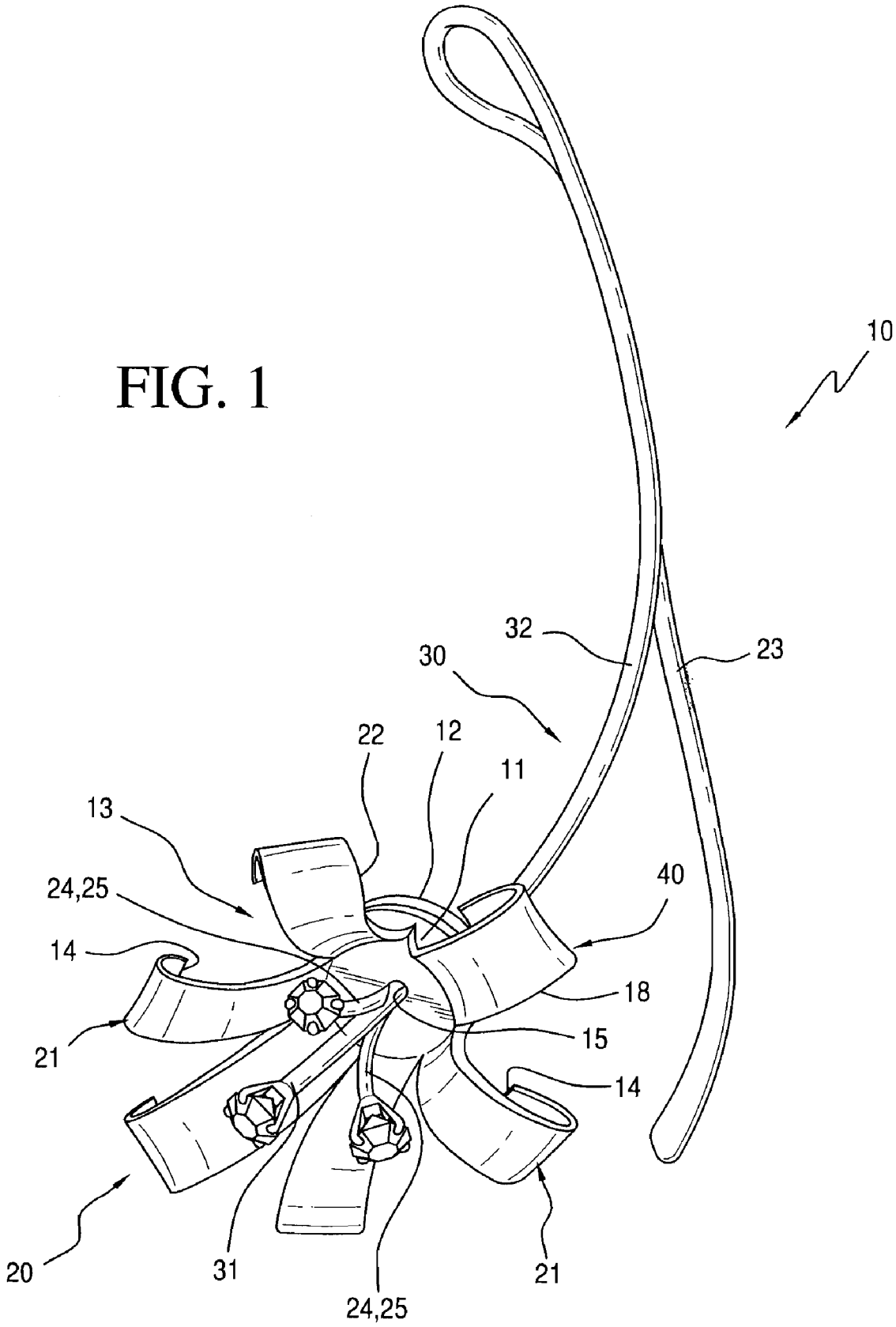

Referring now to the drawings and, more particularly, to FIGS. 1-9 there is shown generally a specific, illustrative jewelry article 10, e.g., of a floral type, according to various aspects of the present invention. In one embodiment, illustrated generally in FIGS. 1-5, the article has a cylindrically cupped housing or body 11 with a closed or base end 12 and an open end 13. The open end has a plurality of edge portions 14 sectioned and shaped such that the body takes the form of a flower 20, each edge portion 14 corresponding to a petal 21 and body 11 corresponding to a sepal 22. The base end of the body has a piercing, perforation or hole 15 for receiving a curvilinear strand 30, optionally therethrough, with a first strand end 31 extending generally from the base end toward the edge portions and a second strand end 32 extending from the base end. The second strand end corresponds to the flower stem 23, and the first strand end is formed into or mounts one or more pistil-like and/or stamen-like shapes 24, 25, respectively. In addition and notably, the body comprises an empty ammunition cartridge or shell 40, or is formed from a shape resembling that of an empty ammunition cartridge casing or shell.

Figure 6:
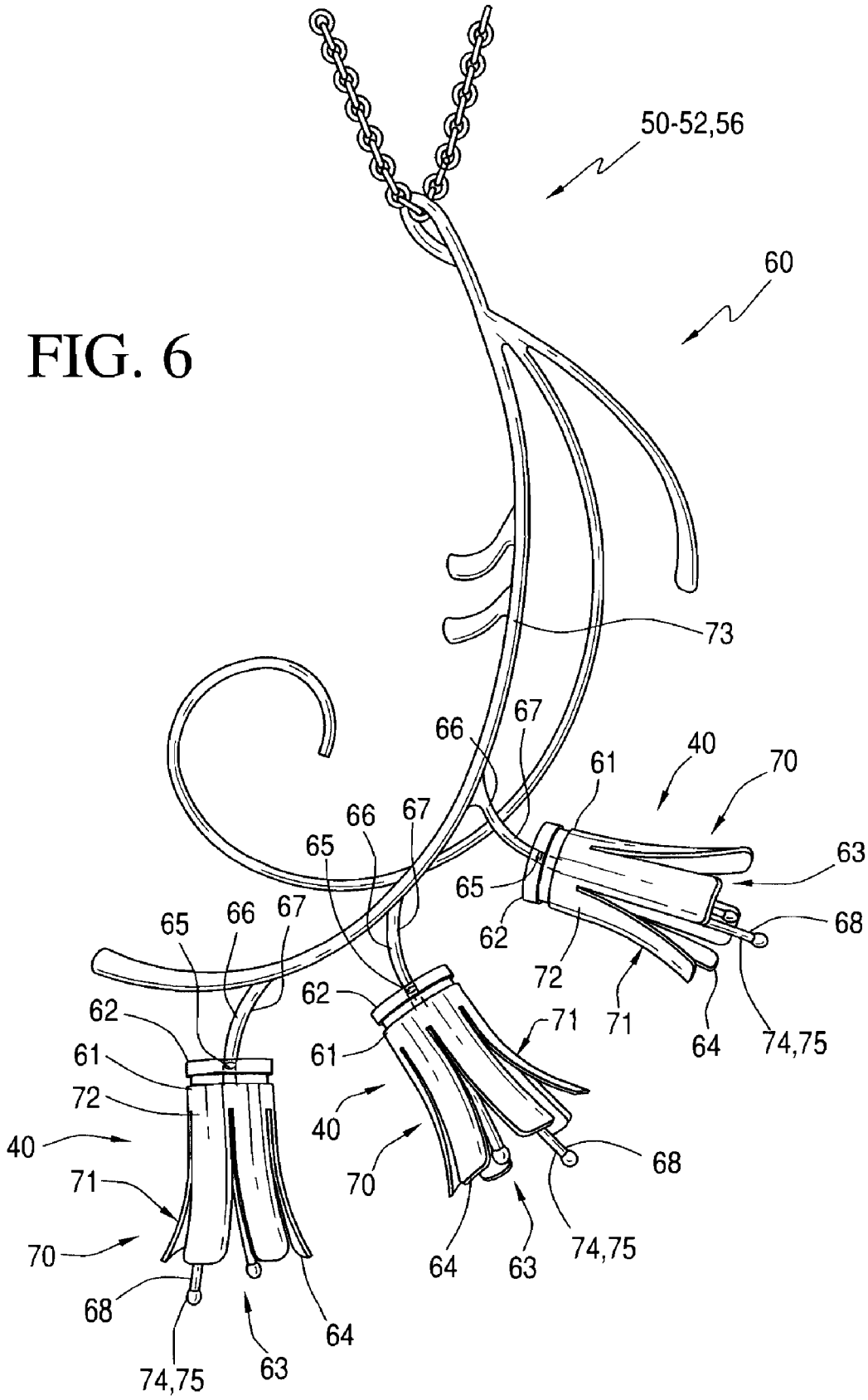
FIG. 6 is a perspective view of a multiple floral-type jewelry article with stem-mounted neck chain, neck wire, bracelet or decorative pin, according to still another aspect of the present invention.

According to one arrangement, best seen in FIGS. 2-5, the first strand end that extends generally from the base end toward the edge portions extends outwardly therefrom and beyond the edge portions a selected distance 16. Alternatively or concurrently, as shown in FIG. 6, the first strand end extends from the base end toward the edge portions but terminates at, in proximity to, and/or below the edge portions a selected distance 17. Further in the alternative or concurrently therewith, a plurality of first strand ends are provided which may extend generally from the base end toward the edge portions and beyond the edge portions a selected distance, terminate at, in proximity to, and/or below the edge portions to one or more selected distances therefrom, and/or in any combination of first strand ends extending beyond the edge portions, terminating at, in proximity to, and/or below the edge portions.

Generally speaking, ammunition casings or shells 40 of any caliber may be utilized, giving consideration to the relative size and general appearance of the jewelry article intended. Suitable shells include, but are not limited to, those of conventional 0.17 caliber, 0.22 caliber, 0.25 caliber, 0.32 caliber, 0.32 caliber wad-cutters, 0.38 caliber, 0.40 caliber, 0.41 caliber, 0.44 special, and 0.50 caliber weapons, 0.357 magnum, 0.380, 0.44 magnum, 6.35 mm, 7.65 mm, 9 mm and 10 mm weapons, it being understood that center fire type shells are considered more workable and are, therefore, more favorable, in accordance with the present invention. In this connection, with regard to use of a 0.22 caliber shell, as such shells typically do not have a predrilled hole, one is desirably provided using a conventional drill and to dimensions similar to the relative shell diameter to piercing, perforation or hole diameter proportions found in the foregoing exemplary shells, giving consideration to the purpose for which such freshly drilled hole is intended.

In addition, it is considered acceptable and is preferred that such casings or shells 40 be from unfired or otherwise empty ammunition, such as newly manufactured but unassembled casings or shells as well as metallic housings formed from fabricated, dye struck or cast pieces designed to resemble ammunition cartridge casings. While considered relatively less desirable, those skilled in the art will appreciate that spent or fired casings or shells may also be utilized, within the spirit and scope of the present invention. Moreover, it will be understood that the term "dye struck" as set forth herein relates, for example, to a method that involves stamping a prefabricated component into a cylindrical form.

Desirably, the stem is constructed of a material of suitable strength and malleability, e.g., a ferrous or non-ferrous metal wire or strands of extruded or molded material, so that it may be bent into a desired shape and affixed to the casing or shell such as by soldering, an adhesive or the like. Alternatively or concurrently therewith, one or more of the strands are a ferrous or non-ferrous metal wire, a colored polymeric material, or a combination of the two are used. As for the body of the jewelry article, it may similarly be constructed of any suitable material including, but not limited to, a precious metal, a non-precious metal, a non-metallic material, or in any combination thereof.

Preferably, as illustrated in the drawing Figures generally, each edge portion 14 is shaped along longitudinally formed sections 18 in the casing or shell, then bent and/or curled so as to create the appearance of petal 21. Also, it is preferred that the article, in general, and first strand end 31 and/or body 11, in particular, mount one or more adornments 33 such as a precious metal, non-precious metal, gem stone, synthetic or simulated gem stone, foil backed gem stone, rhinestones, or other appropriate member, a bead, strands of wire or a polymeric material (colored or non-colored), an LED (or light emitting diode), colored lights, or the like, colored or transparent glass enamel or epoxy enamel. In this manner, an objective of the first strand so adorned is to resemble or correspond to an anther or stigma 26. Further in the alternative or concurrently therewith, as illustrated in FIG. 7, an interior portion 27 of the sepal mounts one or more bead, gem stone, synthetic gem stone or like ornament(s) 34 so as to resemble or correspond to a carpel 28.

Although the present invention is shown and described in connection with selected ornamental members and the like suitably mounted or otherwise affixed to a portion of the article, those skilled in the art will appreciate that other items and techniques may be used to enhance the ornamental appearance and aesthetic appeal of the present invention, giving consideration to the purpose for which the present invention is intended. In addition, while the present invention has been illustrated and described in connection with selected article designs for use in particular settings, it is understood that such designs may be used in any other jewelry or ornamental setting within the scope and spirit of the invention, including, but not limited to, a neck chain 50, neck wire 51, bracelet 52, charm 53, pendant 54, broche 55, decorative pin 56, earring 57 or the like.

Alternatively or concurrently with any of the foregoing embodiments, and as shown in FIG. 6, the article 60 comprises a plurality of cylindrically cupped bodies 61, each having a closed or base end 62 and an open end 63. The open end includes a plurality of edge portions 64 sectioned and shaped such that the body takes the form of a flower 70, each edge portion corresponding to a petal 71 and the body corresponding to a sepal 72. Preferably, the base end of the body has a hole 65 for receiving a curvilinear strand 66 therethrough with a first strand end 67 extending generally from the base end toward the edge portions and a second strand end 68 extending from the base end. The second strand end corresponds to the flower stem 73 and the first strand end is formed into or mounts one or more pistil-like and/or stamen-like shapes 74, 75, respectively. As in the first embodiment, at least one of the bodies, and desirably all of them, comprise, or are formed from, an empty ammunition casing or shell 40, or a shape resembling the same.

Figure 1A:
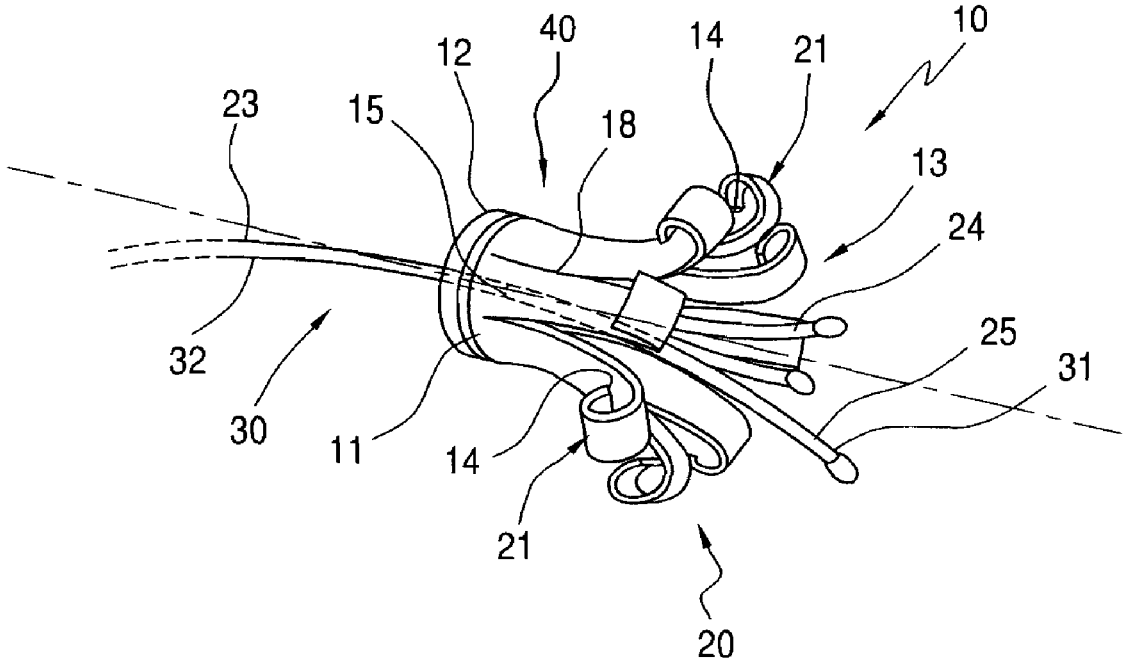
FIG. 1A is a side view of the article illustrated in FIG. 1 showing schematically selected components thereof.
Figure 2:
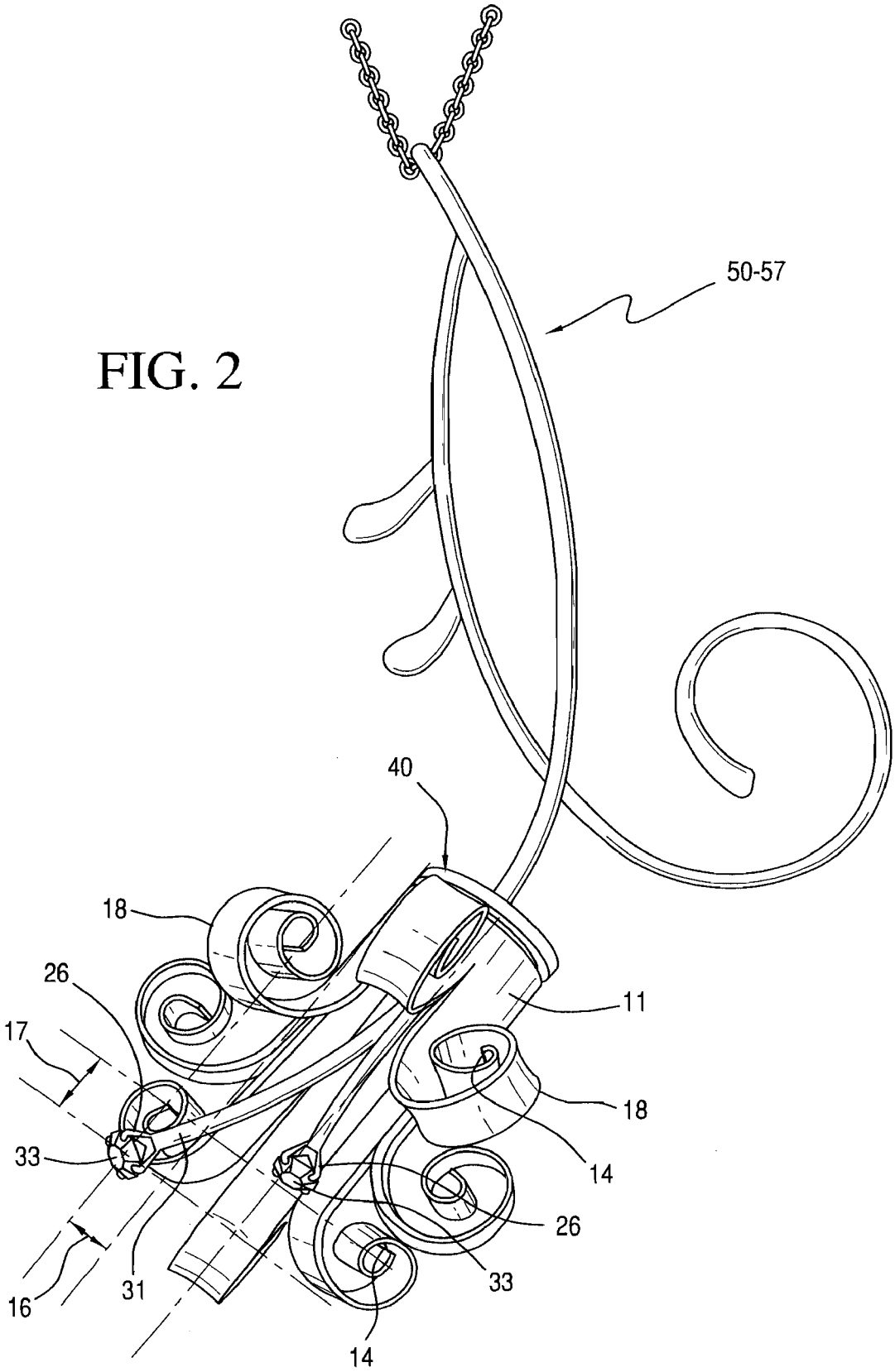
FIG. 2 is a perspective view of an ornate jewelry article with neck chain, neck wire, bracelet or decorative pin, in accordance with another aspect of the present invention.
Figure 3:
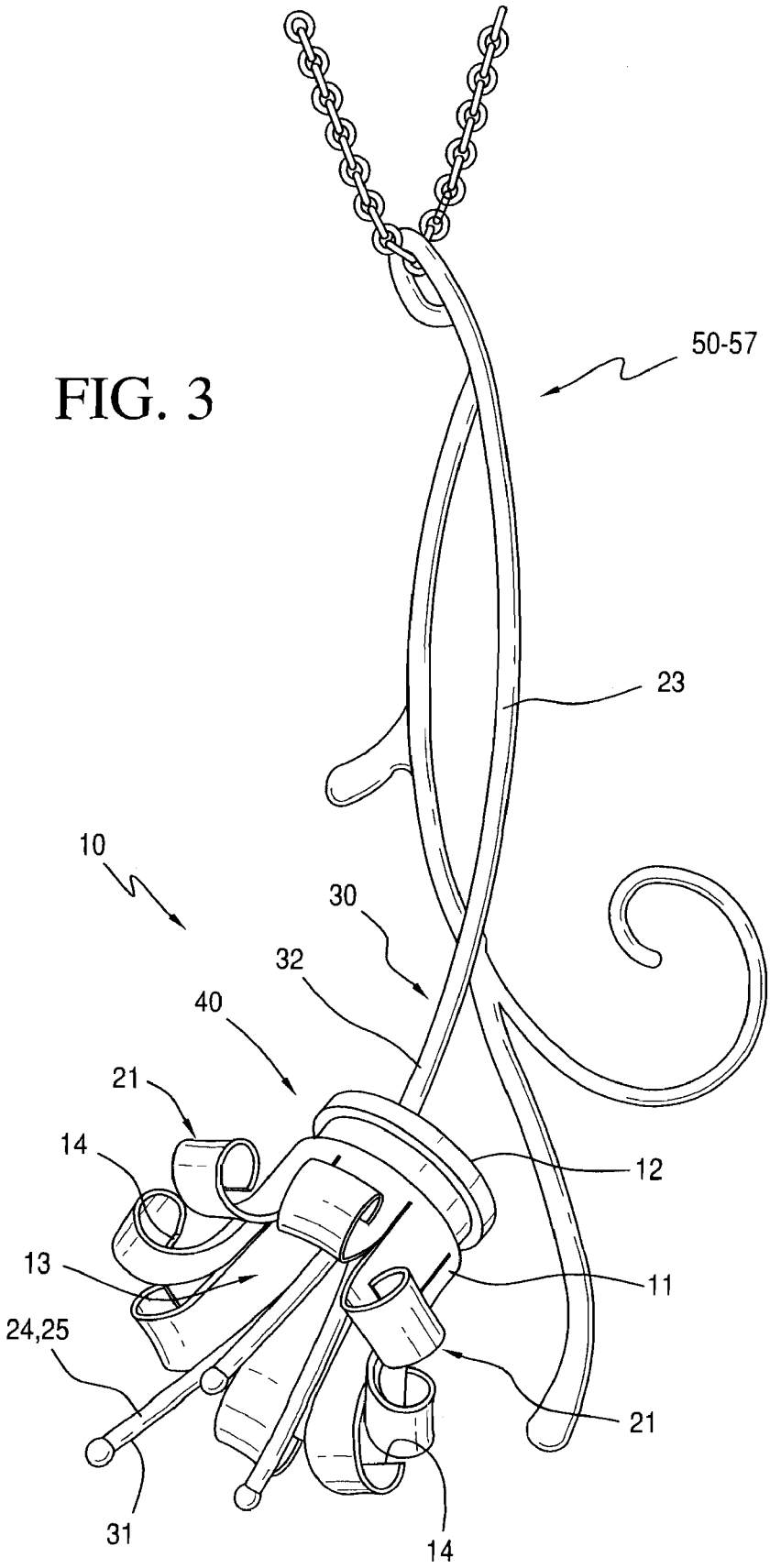
FIG. 3 is a perspective view of a relatively less ornate jewelry article with stem-mounted neck chain, neck wire, bracelet or decorative pin, according to a further aspect of the present invention.
Figure 4:
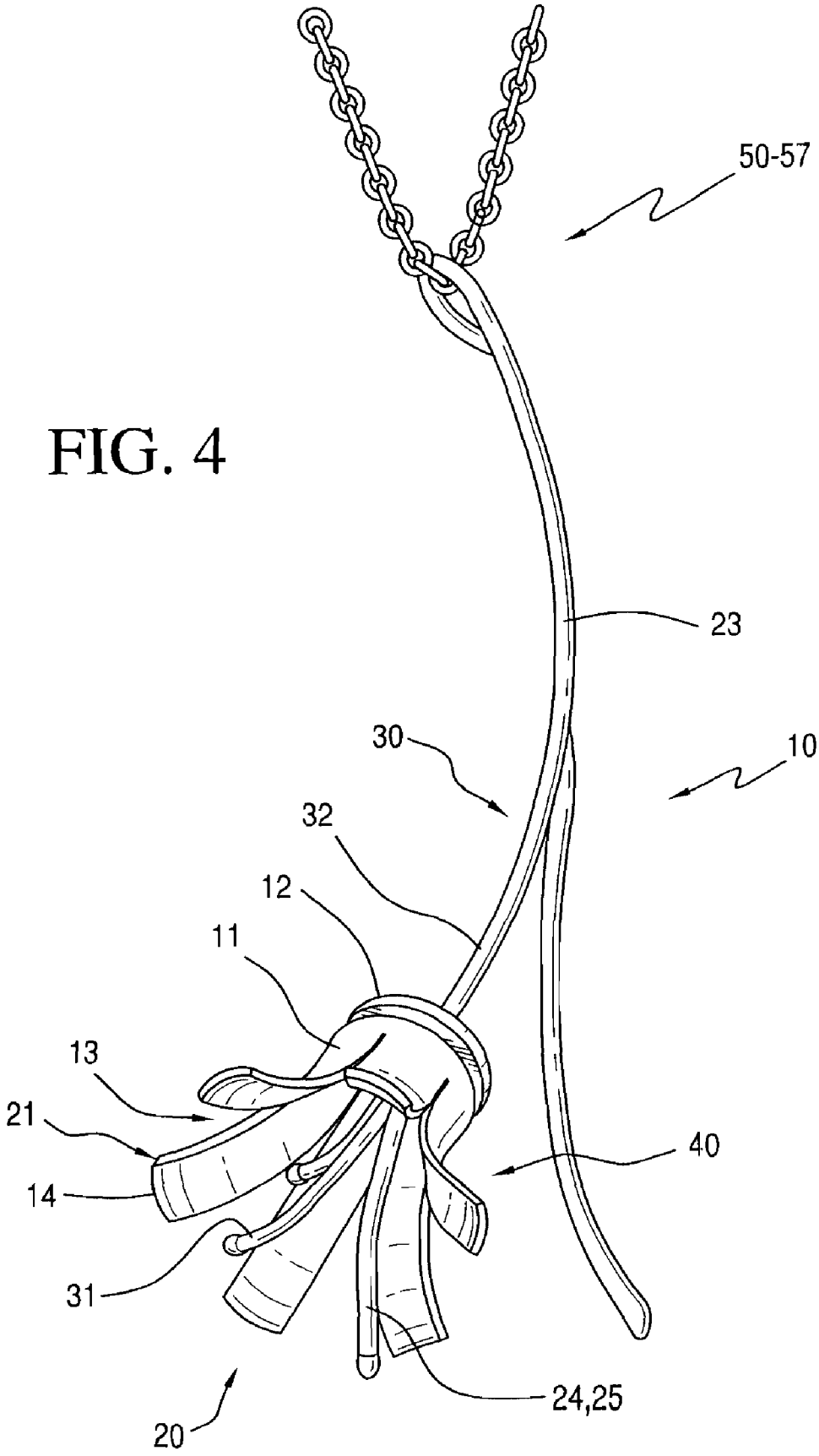
FIG. 4 is a perspective view of a relatively simple jewelry article with stem-mounted neck chain, neck wire, bracelet or decorative pin, according to yet another aspect of the present invention
Figure 5:
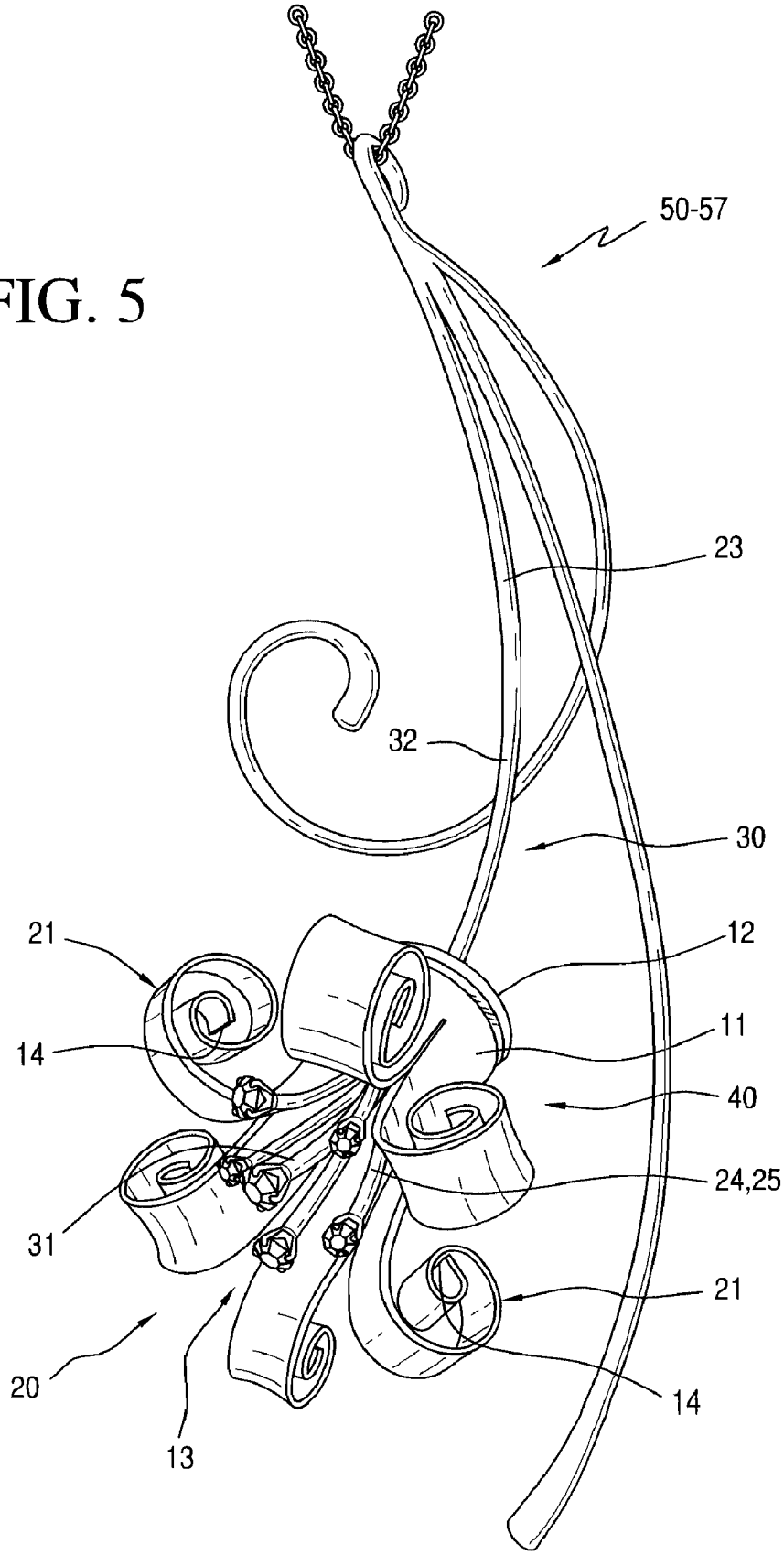
FIG. 5 is a perspective view of an alternative ornate jewelry article with stem-mounted neck chain, neck wire, bracelet or decorative pin, in accordance with the present invention.
Figure 7A:
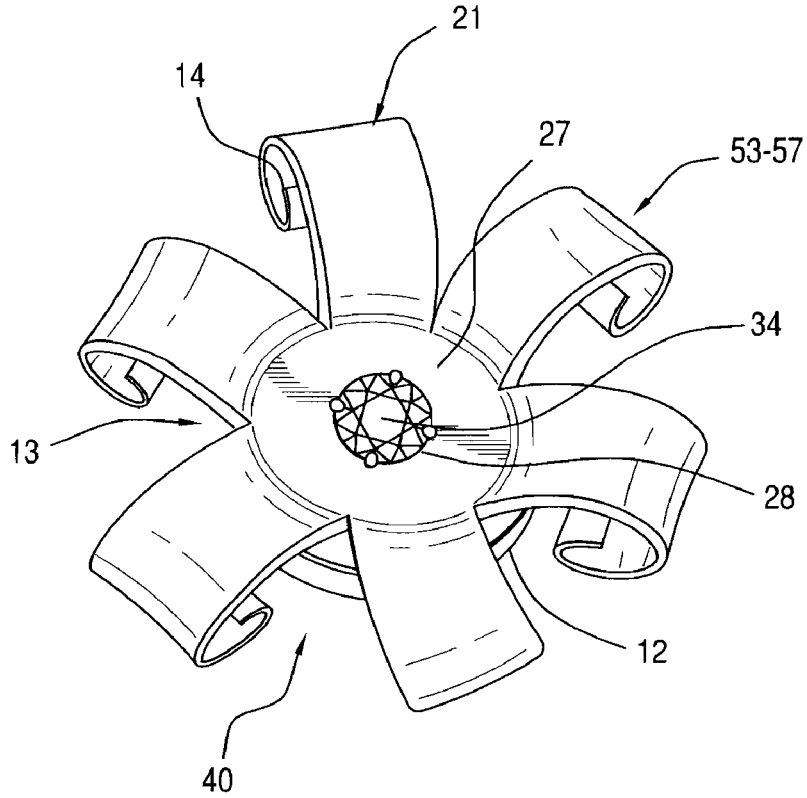
Figure 7B:
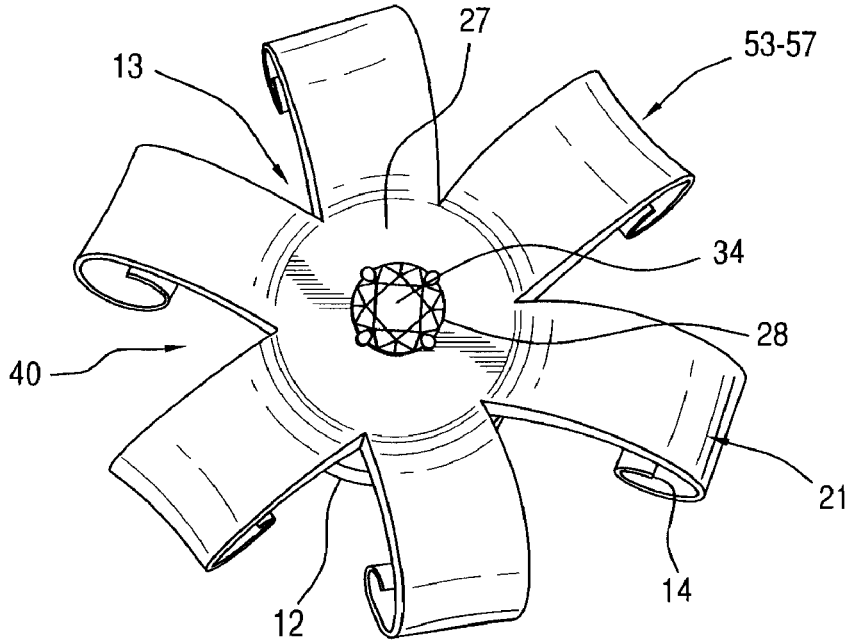
Figure 8:
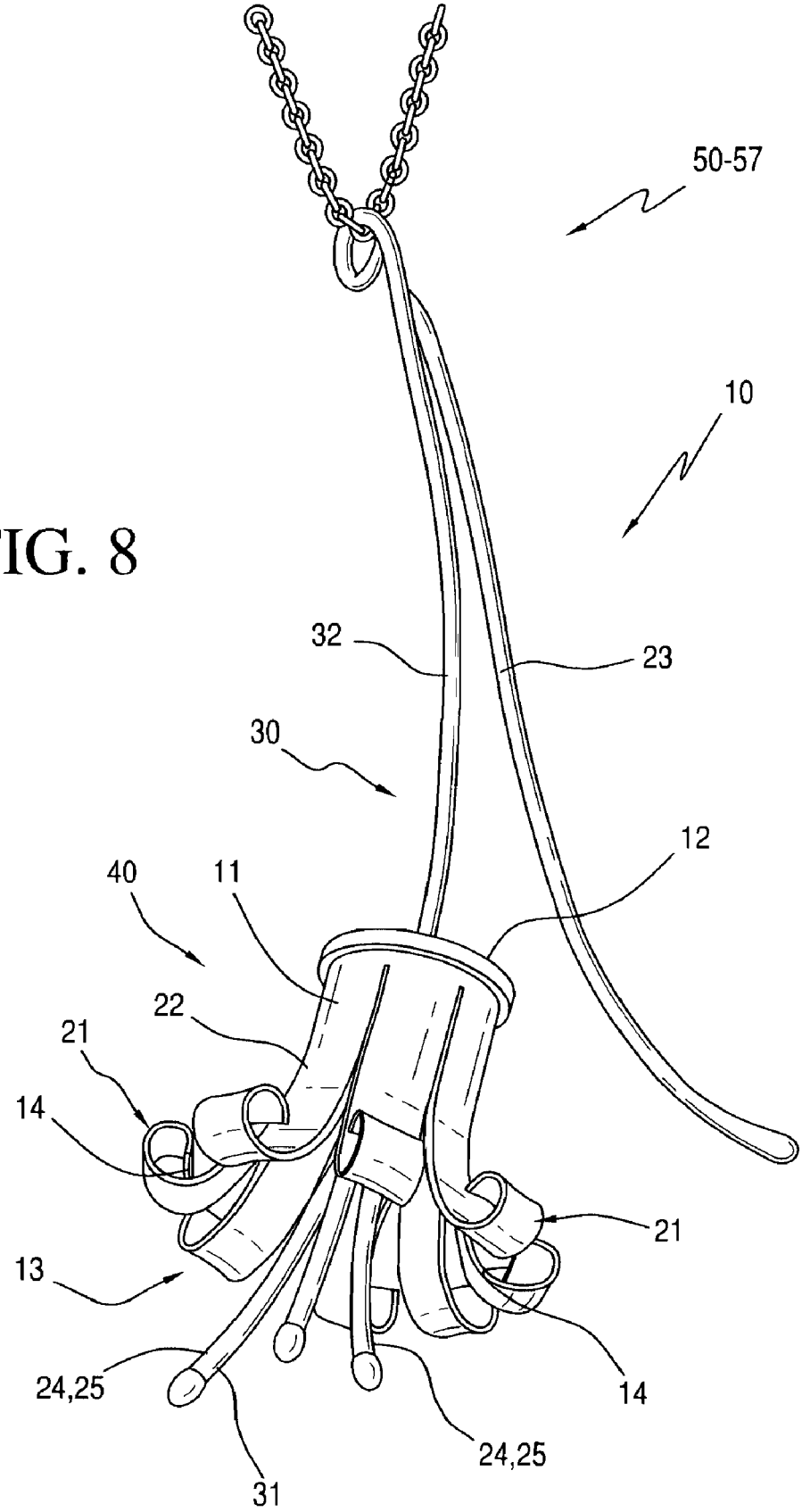
FIG. 8 is a perspective view of a relatively ornate jewelry article, in the alternative to the article illustrated in FIG. 4, with stem-mounted neck chain, neck wire, bracelet or decorative pin.

Overall, the present invention is suitable for adaptation to numerous jewelry articles including, but not limited to, necklace 50, neck wire 51, bracelet 52 or decorative pin 56 as set forth in FIGS. 2-6 and 8, earrings 57, charms 53, pendants 54, broche 55 or decorative pins 56 as shown in FIG. 7, and the pendant, broche, decorative pin or charm mounting at least one floral-like jewelry article 10 such as the one illustrated in FIGS. 1, 1A and 8. Again, the article comprises the cylindrically cupped body with the closed or base end and the open end, the open end having the plurality of edge portions sectioned and shaped such that the body takes the form of the flower selected. Each edge portion corresponds to the flower petal and the body corresponds to the flower sepal. The base end of the body has the piercing, perforation or hole for receiving the curvilinear strand therethrough with the first strand end extending generally from the base end toward the edge portions and the second strand end extending from the base end. The second strand end corresponds to the flower stem and the first strand end is formed into or mounts the one or more pistil-like and/or stamen-like shapes. Finally, the body comprises, or is formed from, an empty ammunition cartridge casing or shell, or a shape resembling the same.

Alternatively or concurrently, in accordance with the present invention, the earring 57, pendant 54, charm 53, broche 55 or decorative pin 56, for instance, as indicated in FIGS. 1 and 8, is provided which mounts a floral-like jewelry article having a cylindrically cupped body with a closed or base end and an open end. The open end has a plurality of edge portions sectioned and shaped such that the body takes the form of a flower. Each edge portion corresponds to a petal and the body corresponds to a sepal. The base end of the body mounts at least one curvilinear strand therethrough with a first strand end extending generally from the base end toward the edge portions, and being formed into or mounting one or more pistil-like and/or stamen-like shapes. Notably, the body again comprises, or is formed from, an empty ammunition cartridge casing or shell, or a shape resembling the same.

In a further embodiment, a modifiable floral-like jewelry article is provided. According to one arrangement, the article has a cylindrically cupped body with a closed or base end and an open end. The open end has a plurality of edge portions sectioned and shaped such that the body takes the form of a flower, each edge portion corresponding to a petal and the body corresponding to a sepal. The base end of the body has a perforation for receiving a curvilinear strand therethrough, optionally removably mounted thereto, with a first strand end extending generally from the base end toward the edge portions and a second strand end extending from the base end. The second strand end corresponds to the flower stem. The first strand end removably mounts one or more components, each having a pistil-like and/or stamen-like shape, such that the user may select and modify, at least in part, the appearance of the jewelry article. As with the previous embodiments, the body comprises, or is formed from, an empty ammunition cartridge casing or shell, or a shape resembling the same.

It is preferred that the one or more components be ornaments suitably mounted to the first strand such as by a friction fit or snap fit connection, and/or are threadably engaged with the first strand end. While the present invention has been shown and described with reference to selected fasteners for securely and/or removably mounting the ornaments to and from the article, it is understood that other items, methods and techniques may be used, whether conventional or non-conventional, without departing from the scope and spirit of the present invention.

The jewelry article, according to various aspects of the present invention, whether in single floral or multiple floral form, and with or without a stem, is further suitable for use with, suspension from or mounting to a conventional or non-conventional necklace, bracelet, charm, earring, pendant, broche, ornamental pin or the like.

Turning now to another aspect of the present invention, there is provided a method for producing a floral-like jewelry article. In one embodiment, a suitable empty ammunition housing, i.e., casing or shell, or a similarly shaped fabricated, dye struck cylindrically-shaped or cast housing is selected. Desirably, the housing has an open end and a closed or base end, the open end including edge portions and the base end having a piercing, perforation or hole. Preliminary to processing according to the steps provided herein, especially in the case of ammunition that has not yet been fired, upon separation of the casing from the bullet assembly, the primer assembly and/or its components is preferably removed so as to expose the hole desired in the base end. In this regard, it is important that live ammunition first be disassembled before being worked according to the present invention. As a precaution, live ammunition must be handled with care, and especially not be hammered or otherwise struck, exposed to heat or a flame, nor tampered with in any other manner that could cause the primer to ignite.

It is preferred, in the alternative, that cartridge casings be obtained, i.e., purchased, without the primer assembly. Such casings typically have a hole in the bottom where the wires may be soldered in. In the case of ammunition that has been fired, the primer assembly is preferably tapped out. According to one arrangement, this may be done using a hammer and steel rod.

Next, the housing is secured in a generally upright position such that the open end is oriented upwardly. Third, and optionally, a plurality of relatively parallel sections are cut in the housing, e.g., lengthwise, generally from the edge portions of the open end toward the base end. In this manner, the sections run along an axis longitudinal with respect to the housing wall and extend a selected distance relative thereto, defining a plurality of adjacent, relatively parallel strip sections. Preferably, cutting is accomplished by a conventional jeweler's saw, laser or like appropriate tool for severing the materials involved, as will be appreciated by those skilled in the art.

Thereafter, it is considered desirable that the housing and strip sections be annealed at a selected temperature for a first selected period of time, and then quenched in a selected fluid bath for a second selected period of time. Alternatively or concurrently, the housing and strip sections are annealed, as desired, without quenching. As those skilled in the art will appreciate, the applicable temperatures, fluids and time periods vary, in general, depending on the metals used and according to the methods of annealing and quenching used. Appropriate methods include, but art not limited to, those deemed conventional in the jewelry and/or metallurgical industries. As also understood by those skilled in the art, the appropriateness of annealing temperatures, quenching fluids and time periods used may also vary by choice and/or the "feel" of the artist, rather than in accordance with exact times, temperatures and fluid compositions.

The stripped sections are then shaped such that each strip takes a form resembling that of a flower petal, and so that the housing takes a form resembling that of a flower. For instance, according to one arrangement, at least one of the stripped sections is shaped into a bend, as shown, for instance, in FIG. 4, so as to resemble a flower petal. Alternatively or concurrently, at least one of the stripped sections is shaped into a curl (See, for example, FIG. 2) such as by rolling and/or heating, similarly to resemble a flower petal. Further in the alternative or concurrently therewith, the stripped sections are formed into one or more selected uniform and/or irregular shapes, illustrated, for instance, in FIG. 9. Acceptable manufacturing tools and techniques include, but are not limited to, conventional hand tools such as pliers, grips, hammers, picks, stamps and the like.

Optionally, the base end of the body is pierced, perforated or punched for slidably receiving a curvilinear strand, the strand being passed through the piercing, perforation or hole in the base end such that a first strand end extends generally from the base end toward the edge portions and a second strand end extends from the base end, the second strand end corresponding to the flower stem.

As another option, the first strand end may be formed into one or more pistil-like and/or stamen-like shapes 24, 25 and/or 74, 75. Alternatively or concurrently, selected adornments 33 are mounted to the body or first strand end, within the spirit and scope of the present invention.

According to yet a further aspect of the present invention, alternatively or concurrently with any of the foregoing method(s), a patina is optionally applied to one or more precious metals, e.g., silver, which may comprise the one or more articles set forth herein. More specifically and desirably, initially, once an article or jewelry item has been fully or substantially constructed, it is cleaned by placing it in an acid bath (also known as a pickling acid). Alternatively or concurrently, the article or item is first quenched in water and/or then placed in the acid bath. It is preferred that the article or item remain in the bath until it is clean, regardless of whether portions of the article or item that are constructed of other materials, e.g., brass, are clean. This, it has been found, is not only because such other materials need not be clean at this point in the process, but also because if the user leaves the article or item in the bath until all other materials are clean as well, he or she runs the risk of chemical reactions occurring between such materials. For instance, it has been found that if brass remains in the acid pickle bath too long, i.e., long enough to also be clean, cooper in the brass may leach out and plate the silver.

Next, the strands inside the shell are pinched together in the middle in order to keep them out of the way for sand blasting and polishing steps to follow. The inside portion of the shell where the patina is desired is then sandblasted or cleaned by other suitable means.

Thereafter, the article or item is placed in a sealed container, e.g., a ZIPLOCK type plastic bag, along with a small rag, sponge or the like soaked in ammonia for a selected time generally within a range of 30 minutes and 90 minutes. In this manner, the fumes from the ammonia cause the inside portion or surface of the shell to turn black, but only if the brass has been cleaned and the alloy surface is sufficiently exposed.

After the inside surface of the shell has turned black, the outside of the shell and around the inside edge of the shell is buffed in order to clean them for the polishing step, and any wire(s), e.g., pistils or petals, that were in the way and had to be bent out of the way previously for polishing and/or sand blasting are bent back into place.

Using a micro-motor hand tool with a wire brush attachment, for instance, the silver is brushed up and shined to a selected luster, according to conventional methods.

Last, if adornments such as gem stones are desired, they may now be set by conventional methods. Although some synthetic stones may be set earlier in the process described above, it is preferred, though not required, that they be set at this point in the process so as to minimize the risk of their being scratched or otherwise damaged during production of the article or items.

Figure 9:
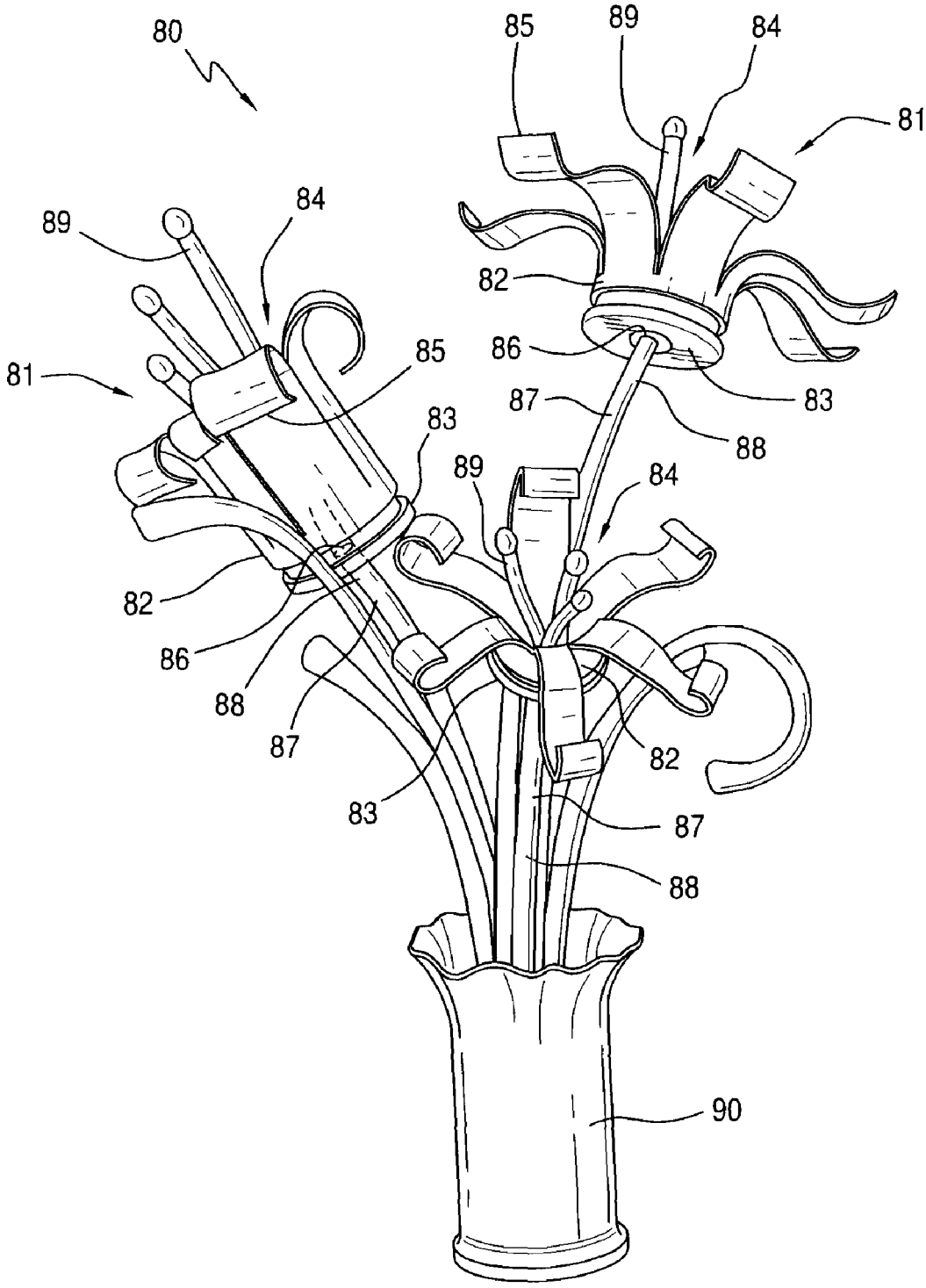
FIG. 9 is a perspective view of a vase comprising a plurality of jewelry articles, according to one aspect of the present invention.

A further arrangement, in accordance with the present invention, is directed to A simulated floral arrangement 80, which comprises a plurality of floral-like jewelry articles 81 extending upwardly and outwardly from a vase portion 90. An article of This general description is illustrated in FIG. 9. Each article 81 comprises a cylindrically cupped body 82 with a closed or base end 83 and an open end 84. The open end has a plurality of edge portions 85 sectioned and shaped such that the body takes the form of a flower, each edge portion corresponding to a petal and the body corresponding to a sepal. Desirably, the base end of the body has a piercing, perforation or hole 86 for receiving a curvilinear strand 87 therethrough with a first strand end 88 extending generally from the base end toward the edge portions and a second strand end 89 extending from the base end. More particularly, in one embodiment, the second strand end corresponds to the flower stem and the first strand end is formed into or mounts one or more pistil-like and/or stamen-like shapes. The vase portion, in turn, mounts each of the plurality of floral-like jewelry articles from their respective second strand ends such that the articles extend upwardly and outwardly therefrom. Of particular significance is that the bodies and the vase each comprise, or are formed from, an empty ammunition cartridge casing or shell, or a shape resembling the same.

In operation, according to one embodiment of the present invention, the vase of the flower arrangement is formed from a shell, metallic member or piece placed over a small anvil. Initially, the piece is annealed and optionally quenched. After annealing, the metal is preferably cleaned, e.g., pickled in a conventional acid bath for cleaning non-ferrous metals. In general, performing this step is not only considered desirable, but, at times, also necessary after an annealing, soldering or like heating process has been performed. During the process of forming, however, while the step of cleaning the metal after annealing is preferred, it is not considered necessary. According to the embodiments set forth herein, the only times that it is important for a piece to be clean, substantially or entirely, is before soldering, before applying the pateina, and upon completion of processing when the article is finished. Generally speaking, as will be appreciated by those skilled in the art, there are a variety of different types of pickles and other suitable acids and acid baths for cleaning metals as are set forth herein.

According to one aspect of the present invention, the forming or shaping step is accomplished using a chasing hammer and a relatively small anvil to create curves in the vase. During this process, the piece is annealed, preferably several times, as necessary. An objective is to soften the metal and prevent it from cracking. Optionally, upon completion of the shaping step, one or more top edges of the shell is carefully melted so as to create a jagged, albeit more interesting, edge for the vase. Alternatively, the top edge may be left unmodified to achieve a different look.

As best seen in FIG. 9, some casting grains may be soldered around the flower stems. The casting grains add to style and place more weight at the bottom of the piece and, hence, the floral arrangement article to aid its standing in an upright position.

In general, the article and its components may be constructed of any suitable material, giving consideration to the purpose for which the present invention is intended. Such materials include those that comprise conventional ammunition cartridge casings or shells, such as brass and other copper alloys as well as alloys of nickel. Other non-ferrous as well as ferrous metals and their alloys are also considered appropriate including, but not limited to, stainless steel and alloys that include lead. Alternatively or concurrently, depending upon the desired aesthetic effect desired, while mindful of cost, other suitable materials of construction include precious metals such as silver, gold, platinum, palladium and their alloys. In this regard, silver, gold and/or rhodium plated materials are considered particularly desirable, within the spirit of the invention. In addition, suitable polymeric materials include, but not limited to, those that are colorized, translucent, transparent, or the like, and with or without a metallic or foil coating, may additionally be deemed appropriate. Moreover, each jewelry article may be constructed of any of the foregoing, in whole or in part, or in any combination thereof, in accordance with various aspects of the present invention.

In summary, the present invention advantageously provides one or more selected jewelry articles that are not only attractive to the wearer or observer, but may also be produced relatively quickly, simply and economically. These article(s) are beneficially constructed of materials that are readily available, inexpensive and easily worked according to conventional or non-conventional methods of materials forming or the like, and may be readily formed and/or assembled using conventional or non-conventional tools, while resulting in jewelry articles that have superior aesthetic appeal to the wearer or the observer and are affordable to the consumer. Additionally, the present invention provides a highly unique and attractive floral-like jewelry article using unique and conventional materials. It further presents a significant advance the art of jewelry design through the exploitation of non-precious metals and other materials, as well as an advance in the scheme of jewelry manufacture through the use of conventional and non-conventional materials, methods and techniques.

Various modifications and alterations to the present invention may be appreciated based on a review of this disclosure. These changes and additions are intended to be within the scope and spirit of this invention as defined by the following claims.

What is claimed is:

1. A floral-like jewelry article comprising:

a cylindrically shaped body defined by a cylindrical housing wall having a housing wall length and a longitudinal axis;

a closed base at a first end of said cylindrical housing wall, said body and base being an empty ammunition casing of a formable metallic material;

an open end defined by an edge of a second end of said cylindrical housing wall, said edge extending transversely to said longitudinal axis of said cylindrical housing wall;

a plurality of adjacent, relatively parallel cuts formed in said cylindrical housing wall of said empty ammunition casing, each said cut extending from said edge toward said base to form a plurality of adjacent, relatively parallel, generally rectangular wall strip sections of said formable metallic material, each of said sections including a segment of said edge of said housing wall and extending a selected distance, less than said housing wall length, along said longitudinal axis from said open end and along said housing wall toward said closed base, each of said rectangular wall strip sections being shaped radially outwardly from said open end with respect to said housing wall of said cylindrical body and in a direction toward said closed base to form a petal of said floral-like jewelry article, said cylindrically shaped body corresponding to a sepal;

a hole in said closed base of said empty ammunition casing; and a curvilinear strand received in said hole, said curvilinear strand having a first strand segment extending in said cylindrically shaped body from said base toward said open end, and a second strand segment extending from said base away from said cylindrically shaped body, said second strand segment being simulative of a stem of said floral-like jewelry article and said first strand segment being one of formed into and mounting at least one of pistil-like and stamen-like shapes.

2. The floral-like jewelry article set forth in claim 1, wherein each said edge portion is shaped by being curled so as to form the appearance of said petal.

3. The floral-like jewelry article set forth in claim 1, wherein each said edge portion is shaped by being bent so as to form the appearance of said petal.

4. The floral-like jewelry article set forth in claim 1, wherein said first strand segment includes a first strand end, one of a bead, a gem stone, a synthetic gem stone and an LED being mounted on said first strand end to one of resemble and correspond to one of an anther and a stigma.

5. The floral-like jewelry article set forth in claim 1, wherein said cylindrically-shaped body is constructed using at least one non-precious metal.

6. The floral-like jewelry article set forth in claim 1, wherein said cylindrically-shaped body is constructed using at least one precious metal.

7. The floral-like jewelry article set forth in claim 1, wherein said curvilinear strand is one of a wire and a colored polymeric material.

8. The floral-like jewelry article set forth in claim 1, wherein an interior portion of said sepal mounts at least one of a bead, a gem stone, and a synthetic gem stone to resemble and correspond to a carpel.

9. The floral-like jewelry article set forth in claim 1, wherein said closed base of said cylindrically shaped body is mounted to said first strand segment by one of friction fit, snap fit and threadable engagement with said curvilinear first strand segment.

10. A floral-like jewelry article comprising:

a cylindrically shaped body defined by a cylindrical housing wall having a housing wall length and a longitudinal axis;

a closed base at a first end of said cylindrical housing wall, said body and base being an empty ammunition casing of a formable metallic material;

an open end defined by an edge of a second end of said cylindrical housing wall, said edge extending transversely to said longitudinal axis of said cylindrical housing wall;

a plurality of adjacent, relatively parallel cuts formed in said cylindrical housing wall of said empty ammunition casing, each said cut extending from said edge toward said base to form a plurality of adjacent, relatively parallel, generally rectangular wall strip sections of said formable metallic material, each of said sections including a segment of said edge of said housing wall and extending a selected distance, less than said housing wall length, along said longitudinal axis from said open end and along said housing wall toward said closed base, each of said rectangular wall strip sections being shaped radially outwardly from said open end with respect to said housing wall of said cylindrical body and in a direction toward said closed base to form a petal of said floral-like jewelry article, said cylindrically shaped body corresponding to a sepal; and a curvilinear strand having a first strand segment extending in said cylindrically shaped body from said base toward said open end, and being one of formed into and mounting at least one of a simulative pistil-like and a stamen-like shape of said floral-like jewelry article.

* * * * *